United States Patent [19]

Thirion

[11] Patent Number: 4,790,228

[45] Date of Patent: Dec. 13, 1988

[54] ACOUSTIC DRUM

[76] Inventor: Terry R. Thirion, 5910 Thomas Ave., Schofield, Wis. 54476

[21] Appl. No.: 70,554

[22] Filed: Jul. 7, 1987

Related U.S. Application Data

[62] Division of Ser. No. 666,436, Oct. 30, 1984, Pat. No. 2,731,141.

[51] Int. Cl.[4] ..... G10D 13/02

[52] U.S. Cl. ..... 84/411 R; 84/415

[58] Field of Search ..... 84/411 R, 411–422

[56] References Cited

U.S. PATENT DOCUMENTS

| | | | |
|---|---|---|---|
| 3,055,253 | 9/1962 | Loughborough | 84/411 R |
| 3,680,425 | 8/1972 | Morena et al. | 84/411 R |
| 4,168,646 | 9/1979 | May | 84/411 R X |
| 4,173,917 | 11/1979 | Della-Porta | 84/419 |
| 4,184,407 | 1/1980 | Townshend | 84/411 R |
| 4,214,504 | 7/1980 | Rex | 84/411 R |

FOREIGN PATENT DOCUMENTS

| | | | |
|---|---|---|---|
| 1299073 | 12/1972 | United Kingdom | 84/411 R |

*Primary Examiner*—Lawrence R. Franklin
*Attorney, Agent, or Firm*—Arthur J. Hansmann

[57] ABSTRACT

A method and a drum made of a moldable material, such as fiberglass, in a cylindrical form and having a low friction material coating the inside thereof and having a sound opening and baffle formed in the cylinder, for enhancement of resonance. The cylindrical drum is made through the utilization of the low friction material on the interior of fiberglass, and the two are bonded together because of the use of a paper on which the low friction material is a coating.

2 Claims, 1 Drawing Sheet

FIG. 1
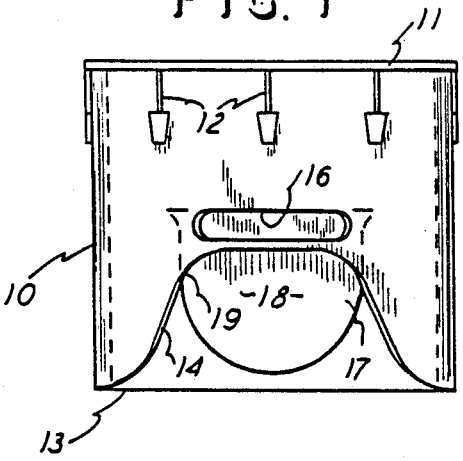
FIG. 2
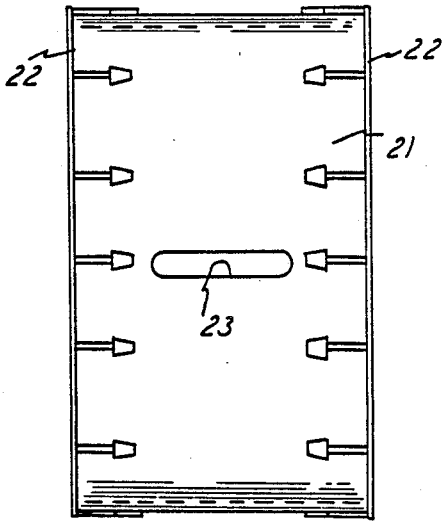
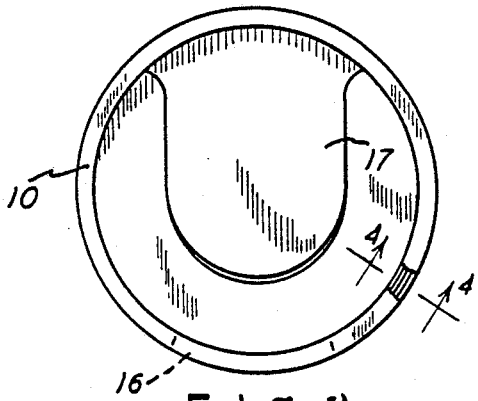
FIG. 3
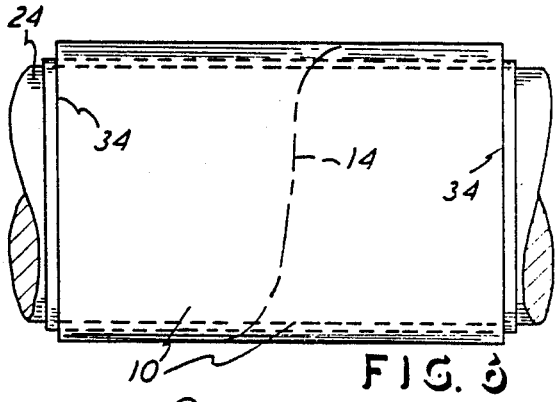
FIG. 6
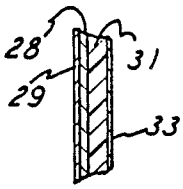
FIG. 4
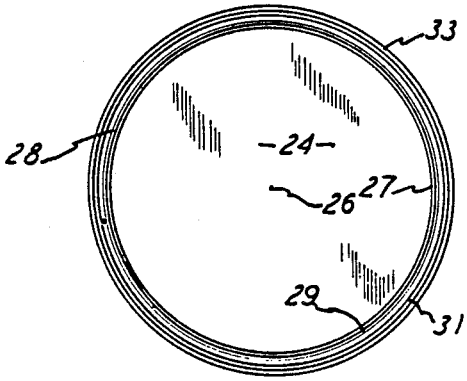
FIG. 5

ACOUSTIC DRUM

This application is a division of application Ser. No. 666,436 filed Oct. 30, 1984, now U.S. Pat. No. 4,731,141.

This invention relates to an acoustic drum, and it pertains to the method of making the drum and to the drum construction itself.

BACKGROUND OF THE INVENTION

Drums are conventionally made in cylindrical configurations with percussion heads extending over one or both of the ends of the cylinder. These prior art constructions are shown in U.S. Pat. Nos. 3,435,723, 3,603,194, 3,680,425, 4,045,264, 4,102,236, 4,184,407, and 4,356,756.

The present invention differs from the prior in that it provides for a method of making the drums' cylindrical body from a moldable material, such as fiberglass, and providing a low friction on the interior thereof. Also, the drum is provided with an opening in the cylindrical body, for enhancing the resonance, and a sound vibration baffle can also be positioned on the interior of the cylinder to direct vibrations toward the opening.

The consequence of the present invention is to provide a sturdy and lightweight drum, of various styles such as tenor drums, tom-tom drums, bass drums, snare drums, and all such styles of drums utilizing cylindrical bodies and the percussion type of drumhead.

By utilizing a moldable material, such as fiberglass or a plastic material, the drum of this invention can be readily and easily manufactured and is lightweight and extremely sturdy, and these features are achieved with a resulting drum which is of outstanding qualities for resonance. In accomplishing this, a low friction material, such as a coating of MYLAR which is a polyester and is a trademark of the E.I. DuPont de Nemours & Co., Inc. That low friction material makes it possible to form the drum on a cylindrical mandrel and to then remove the formed drum by having the low friction material interposed between the moldable material and the mandrel so that the drum can be slid off the mandrel.

In considering the characteristics of drums, it should be understood that the cylindrical bodies are commonly made of extremely strong material, which may be either heavy or thick or expensive, all of which is undesirable, in order to have the cylindrical body withstand the tension applied thereto by the drumhead itself. However, with the cylindrical body of the present invention, the body is lightweight but yet sufficiently strong to withstand the force applied thereto by the drumhead of a special or modern design.

Low friction material, such as MYLAR, cannot be employed as a coating directly on a moldable material, such as fiberglass, and thus a special arrangement is devised by this invention, namely, that the MYLAR be a coating on paper which itself is then in contact with the fiberglass or the like. With that arrangement, the MYLAR coated paper will bond to the fiberglass, and thus the MYLAR can be employed to provide for the removal of the cured cylinder from the mandrel. Further, the MYLAR provides for enhanced resonance on the interior of the drum, where it is significant.

BRIEF DESCRIPTION OF THE DRAWINGS

FIG. 1 is a front elevational view of a drum of this invention.

FIG. 2 is a front elevational view of another drum of this invention.

FIG. 3 is a bottom plan view of FIG. 1.

FIG. 4. is an enlarged sectional view taken on the line 4—4 of FIG. 3.

FIG. 5 is an end view of the drum of this invention on a mandrel.

FIG. 6 is a side elevational view of a drum of this invention on a mandrel.

DETAILED DESCRIPTION OF THE PREFERRED EMBODIMENT & METHOD

FIG. 1 shows a tenor or tom-tom drum of this invention which includes the cylindrical body 10 and the drumhead 11 extended over one end of the cylinder. Conventional and suitable attaching members 12 extend between the cylinder 10 and the drum 11 to secure the latter in a taut manner to the cylinder 10. The cylinder end opposite the head 11 includes the partly straight edge 13 which is parallel to the head 11 and the French curve type of edge 14 which extends upwardly into the cylinder body 10, as shown. That is, the entire lower end of the drum shown is open, and it has the French curve edge 14, as shown. Also, the body 10 has a sound-resonance elongated opening 16 which is formed in the body 10 for the escape of sound vibrations to thereby enhance the quality and repercussion features of the drums. Finally, a sound baffle 17 is affixed to the interior of the cylindrical body 10, and extends inwardly therefrom, as shown in FIGS. 1 and 3, and has a facing surface 18 which is faced toward the opening 16. The baffle 17 is disposed to intersect with the diametrical line across the cylinder 10 and through the opening 16, as shown, and it therefore directs the sound vibrations from the head 11 into the sound opening 16. There is also an opening designated 19 and formed by the French curve edge 14, and the baffle 17 is also disposed to intersect with the diametrical line across the cylinder 10 and through the opening 19, and it therefore directs the sound vibrations from the head 11 into the sound opening 19.

FIG. 2 shows a bass drum with a cylindrical body 21 and its usual two drumheads 22 attached thereto, and it has the sound opening 23 of this invention formed therein, for enhancing the repercussion feature of the drum.

FIG. 5 and FIG. 6 show the formation of the drum, and the method of making the drum is done on a cylindrical rotating mandrel 24 which has its longitudinal axis 26 in the horizontal direction, as shown. The mandrel is of steel material, and a cardboard 27 is wrapped endlessly therearound. Next, a sheet of paper 28 is wrapped over the cardboard 27, endlessly therearound, and it has a coating 29, on the interior thereof, and this may be the polyester or MYLAR low friction type of coating material. Next, moldable material, such as fiberglass 31 is placed over the paper 28 and again endlessly around, so that they all form cylinders of endless configuration. The moldable material 31 is applied in a molten form while the mandrel 24 is rotating. Upon curing of the moldable material 31, there will be a bond between the paper 28 and the moldable or fiberglass material 31, as desired. In that manner, the interior of the drum's cylindrical body 10 is provided with the high gloss and low friction surface of excellent resonance, quality, and of a capability of sliding that MYLAR or like material 29 over the cardboard 27 to thus release the cured cylindrical body 10 from the mandrel. No special tools are required for the release, but it has been found that it can be done manually, and that is a great advantage. Finally, an exterior decorative and finish sheet material 33 can be affixed to the exterior of the fiberglass 31 to then finish the cylindrical body 10.

FIG. 6 shows that two drum bodies 10 can be made at one time on the mandrel 24, and thus their two top edges 34 are planar edges, and the French curve 14 can then be cut along the center portion of the one continuous and long cylinder as shown in FIG. 6, so that the two cylindrical bodies 10 are formed by cutting one long cylinder into the two drums, as shown.

FIG. 4 shows an enlarged view of the various elements in somewhat relative thicknesses, and it will be seen and understood that the moldable material or fiberglass 31 is the thickest material of all of those materials cylindrically applied to form the cylindrical body 10.

Therefore, the MYLAR or like low friction material can be bonded to the fiberglass 31, by virtue of utilizing the MYLAR as a coating on the paper 28 which permits the bonding to the fiberglass. The MYLAR cannot otherwise be bonded to fiberglass in the permanent manner required and to achieve the sound resonance required for the drum.

With this method and resulting drum, the drum of this invention is of considerable less weight then correspondingly sized and styles of drums presently on the market, and, in fact, the drum of this invention is up to 50% less weight then drums of corresponding overall dimension. Further, there is an enhanced resonance quality, due to the gloss or MYLAR coating on the interior of the drum, while still permitting the use of high strength but lightweight moldable material, such as the fiberglass. The improvement in sound resonance is due to the interior and also to the sound opening 16 and the opening 23, as well as with the baffle 17. All three of those characteristics each provides a sound improvement, compared to conventional drums. Thus, the MYLAR coated paper can be a 40 lb. Kraft paper of an overall thickness of approximately 0.002 inches; and the fiberglass can be the cloth and resin combination which has a thickness of 0.050 inches to 0.070 inches; finally, the exterior covering or coating could be a pressure sensitive covering sheet of a conventional material of approximately 0.005 inches to 0.010 inches. The respective overall ranges of thicknesses could be 0.030 inches to 0.250 inches for the fiberglass, and 0.001 inches to 0.015 inches for the MYLAR, and 0.002 inches to 0.030 inches for the finish sheet 33. Also, the drumheads 11 and 22 could be made according to U.S. Pat. No. 4,356,756 so that the fiberglass or like cylindrical body 10 can be of its thin and lightweight material and yet sufficiently sturdy to withstand the tensions required by the drumhead.

In this terminology, the mandrel includes the cardboard 27. Also, the line 19 is a symmetrically curved line as the one shown in FIG. 6.

What is claimed is:

1. In an acoustic drum consisting of a hollow cylindrical body having a single cylindrical opening extending along the longitudinal axis of said cylindrical body, a percussion drum head extending over one end of said cylindrical body, the end of said cylindrical body opposite said one end being completely open and being defined by a teriminal edge on said cylindrical body, the improvement comprising said cylindrical body having only one elongated opening extending diametrically therethrough and at a location spaced from said terminal edge for the passage of sound waves through said opening, and the elongated axis of said elongated opening extending along the circumference of said cylindrical body for only a minor fraction of the total length of said circumference, to thereby have the sound waves which pass through said elongated opening be directed only transverse to said longitudinal axis of said cylindrical body, and a baffle affixed to the interior of said cylindrical body and extending at an obtuse angle to said longitudinal axis and having a face directed toward said elongated opening for deflecting sound waves from said drum head and through said elongated opening.

2. The acoustic drum as claimed in claim 1, wherein said terminal edge includes a portion curved toward and away from said elongated opening and being at the location adjacent said elongated opening, to thereby present an additional opening in said cylindrical body for the passage of sound waves deflected off said baffle.

* * * * *